US005946520A

United States Patent [19]

Hooper et al.

[11] Patent Number: 5,946,520

[45] Date of Patent: Aug. 31, 1999

[54] ANTI-FRAUD PULL TAB SYSTEM FOR PRINTING PRODUCTS

[75] Inventors: Howard G. Hooper; K. Trent Christensen; Andrew J. Binder, all of Boise, Id.

[73] Assignee: Hewlett-Packard Company, Palo Alto, Calif.

[21] Appl. No.: 08/867,708

[22] Filed: Jun. 2, 1997

[51] Int. Cl.[6] ..... G03G 15/00

[52] U.S. Cl. ..... 399/12; 399/102; 399/103; 399/109; 399/111

[58] Field of Search ..... 399/1, 12, 102, 399/103, 107, 109, 110, 111, 106

[56] References Cited

U.S. PATENT DOCUMENTS

| | | | |
|---|---|---|---|
| 3,976,215 | 8/1976 | Smalley . | |
| 4,194,681 | 3/1980 | Scott et al. . | |
| 4,427,134 | 1/1984 | Almouli . | |
| 4,627,550 | 12/1986 | Dines . | |
| 4,643,329 | 2/1987 | Mobberley et al. . | |
| 4,827,307 | 5/1989 | Zoltner | 399/106 |
| 5,082,702 | 1/1992 | Alband . | |
| 5,201,440 | 4/1993 | Gross . | |
| 5,568,951 | 10/1996 | Morgan . | |
| 5,594,535 | 1/1997 | Beaufort et al. | 399/106 X |
| 5,718,357 | 2/1998 | Dang . | |

*Primary Examiner*—Sandra Brase

[57] ABSTRACT

An anti-fraud pull tab system for removable protective barriers in print cartridges and other modular components used in printers, copiers and other image forming devices. The pull tab includes a pull ring and a use indicator. The use indicator blocks a substantial portion of the finger hole in the pull ring so that the use indicator is broken out, damaged or disfigured when the pull tab is used to remove the protective barrier. The disfigured pull tab indicates the protective barrier has been used, thus making it difficult for a counterfeiter to successfully re-use or reform the protective barrier and resell the cartridge as a new cartridge. In an alternative embodiment of the invention, a pull tab assembly includes a pull tab and an identifying tape. The tape secures the pull tab to the print cartridge. Affixed to the tape is a use indicator that will permanently adhere to the print cartridge when the identifying tape is removed from the cartridge. When a pull tab is unnecessary or undesirable, the identifying tape may be attached directly to the end of the protective barrier.

12 Claims, 6 Drawing Sheets

ANTI-FRAUD PULL TAB SYSTEM FOR PRINTING PRODUCTS

FIELD OF THE INVENTION

The present invention relates generally to printing equipment and, more particularly, to an anti-fraud pull tab system for removable protective barriers, retainers, wrappings and the like used in modular components for printers, copiers and other image forming devices.

BACKGROUND OF THE INVENTION

Printers, copiers and facsimile machines use modular print components. For example, many laser printers now use a replaceable print cartridge that houses the toner reservoir, the photoconductive drum assembly, and the charge and developer roller assemblies. When the toner is gone, the entire cartridge is replaced. Modular cartridges may also be used for other components of the printing device that are consumed or otherwise replaced over the useful life of the device. It is often cost effective and more environmentally friendly to recycle a used cartridge rather than discard it and replace it with a completely new cartridge. Hence, used cartridges are sometimes refurbished or their components incorporated into re-manufactured cartridges or recycled into new cartridges.

Print cartridges are usually sealed in a plastic bag and placed in a cardboard box for storage and shipping. Counterfeiters have been able to re-use or duplicate this type of packaging to sell used or re-manufactured cartridges as new cartridges. Counterfeit cartridges are low quality. The sale of counterfeit cartridges cheats consumers out of a quality product, reduces sales for legitimate manufacturers and damages the goodwill these manufacturers have gained for their high quality products.

Print cartridges for laser printers, also commonly called toner cartridges, typically include a toner reservoir, the photoconductor and the charging and toner delivery assemblies. A removable protective barrier called a toner dam is inserted between the toner reservoir portion of the cartridge and the other print components. The toner dam keeps the toner powder separated from the photoconductor and the charging and toner delivery assemblies during shipping and handling. The toner dam is removed by the user just before the cartridge is installed into the printer. Because conventional toner dams have no mechanism for indicating the cartridge is new, counterfeiters can reinsert or reform the toner dam and resell a used cartridge as new. Pull tabs molded to the cartridge so that the pull tab must be broken free of the cartridge to pull out the toner dam have also helped deter counterfeiting. However, because the toner dams and pull tabs have no identifying features, there is still an opportunity for reinserting or reforming a toner dam as part of a counterfeit cartridge.

SUMMARY OF THE INVENTION

Accordingly, the present invention is directed to a new anti-fraud pull tab system for removable protective barriers in print cartridges and other modular components used in printers, copiers and other image forming devices. The pull tab includes a pull ring and a use indicator. The use indicator blocks a substantial portion of the finger hole in the pull ring so that the use indicator is broken out, damaged or disfigured when the pull tab is used to remove the protective barrier. The disfigured pull tab indicates the protective barrier has been used, thus making it difficult for a counterfeiter to successfully re-use or reform the protective barrier and resell the cartridge as a new cartridge.

In an alternative embodiment of the invention, a pull tab assembly includes a pull tab and an identifying tape. The tape secures the pull tab to the print cartridge. Affixed to the tape is a use indicator that will permanently adhere to the print cartridge when the identifying tape is removed from the cartridge. When a pull tab is unnecessary or undesirable, the identifying tape may be attached directly to the protective barrier.

DETAILED DESCRIPTION OF THE INVENTION

Figure 1:
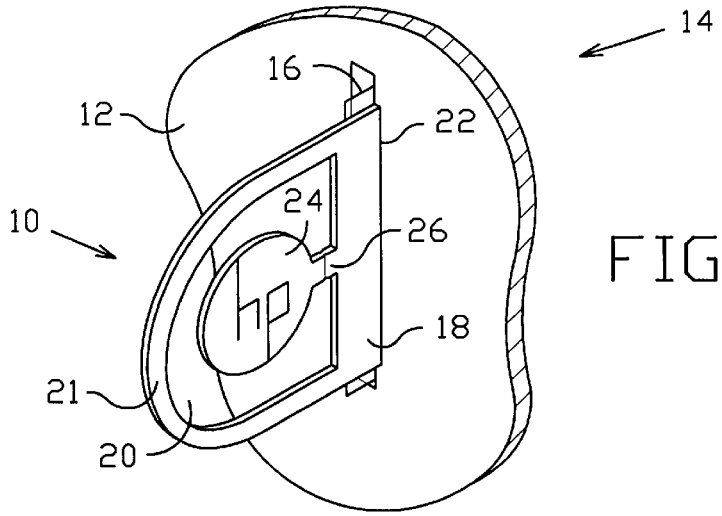
FIGS. 1–3 are perspective views of a portion of the end of a print cartridge showing an anti-fraud pull tab with a breakaway insert type use indicator at various stages of removal of the toner dam.
Figure 2:
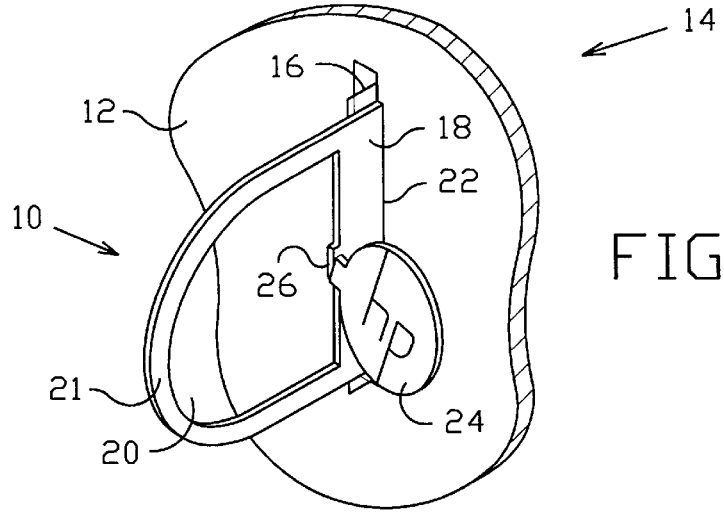
Figure 3:
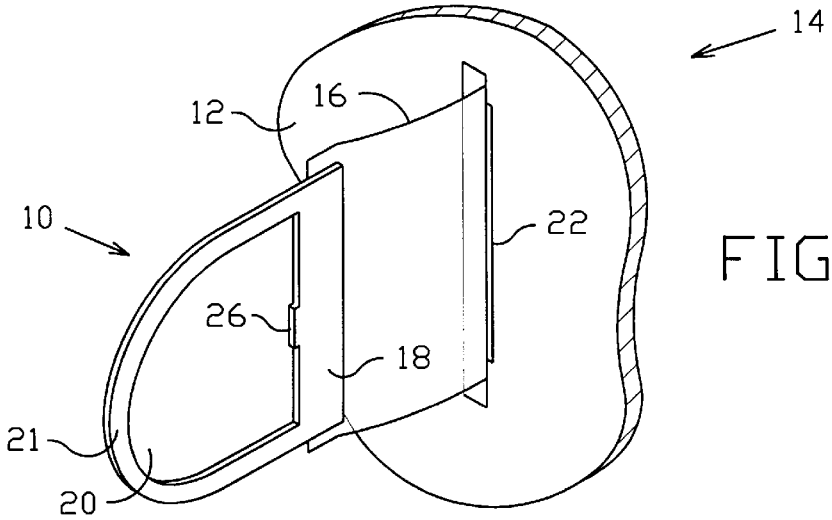

Referring to FIGS. 1, 2 and 3, pull tab 10 is attached to housing 12 of print cartridge 14. As best seen in FIG. 3, pull tab 10 is affixed to a removable protective barrier 16. For the print cartridge used to illustrate the anti-fraud pull tab, protective barrier 16 represents a toner dam that separates the toner reservoir portion of the print cartridge from the photoconductor and charging and toner delivery assemblies. Pull tab 10 could also be used with removable protective barriers, retainers, wrappings or any other protective device that is removed prior to installing modular components, such as print cartridges, fusers, intermediate transfer assemblies and the like.

Pull tab 10 has a base portion 18 and a finger hole 20 defined by a pull ring 21. For some types of molded plastic housings, base portion 18 is attached to and extends away from housing 12 at a location designated by reference numeral 22. For other housings, pull tab 10 is not attached to the housing, it just dangles on the end of toner dam 16.

A breakaway insert type use indicator 24 is attached to base portion 18. Preferably, use indicator 24 is imprinted with an identification symbol, such as the Hewlett Packard Company logo. Use indicator 24 projects into and blocks a substantial portion of finger hole 20. Use indicator 24 is attached to base portion 18 through a comparatively weak and easily broken bridge region 26. When the user inserts a finger into finger hole 20, use indicator 24 is broken out of the pull tab, as shown in FIG. 2. As the user pulls on pull tab 10, it breaks away from housing 12, as shown FIG. 3. Use indicator 24 could extend from the pull ring portion 21 of pull tab 10, rather than from base portion 22. What is important is that use indicator 24 block finger hole 20 sufficient to require that it be broken out, damaged or disfigured when toner dam 16 is removed from cartridge 14. The disfigured pull tab indicates the toner dam has been used, thus making it difficult for a counterfeiter to successfully reinsert the toner dam and resell the cartridge as a new cartridge.

Figure 4:
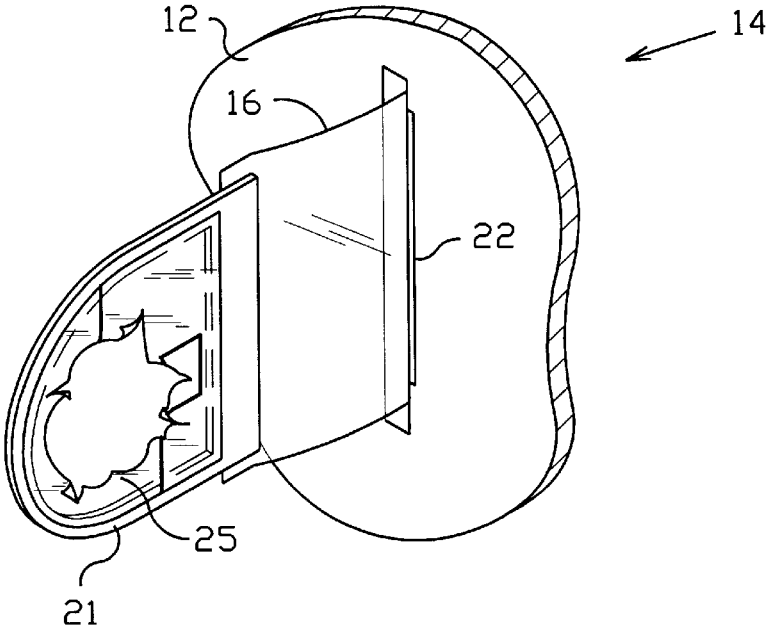
FIG. 4 is a perspective view of a portion of the end of a print cartridge showing an anti-fraud pull tab with a breakable membrane use indicator.

One variation of this breakaway use indicator embodiment is illustrated in FIG. 4. In FIG. 4, a membrane 25 extends across finger hole 20. Membrane 25 is permanently affixed to pull tab 10. When the user inserts a finger into fingerhole 20, membrane 25 breaks. The remnants of membrane 25 indicate the toner dam and, therefore the cartridge, has been used.

Figure 5:
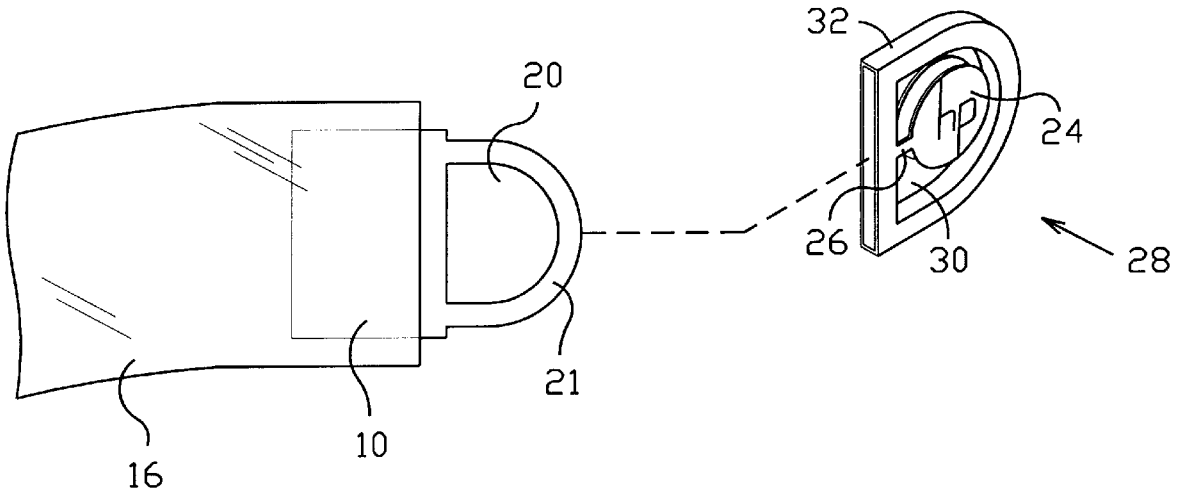
FIG. 5 is a detail view of an alternative anti-fraud pull tab that utilizes a sleeve containing a breakaway insert type use indicator.
Figure 6:
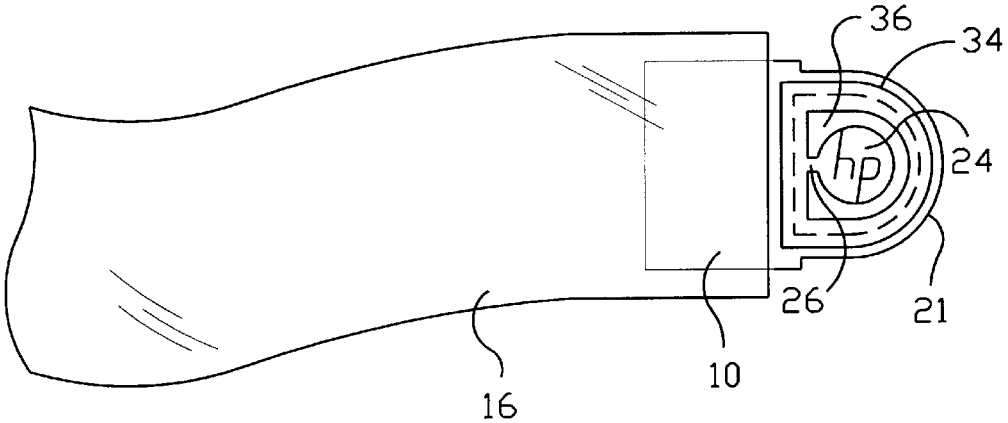
FIG. 6 is a detail view of another alternative anti-fraud pull tab that utilizes an insert containing a breakaway insert type use indicator.

Two alternative embodiments of the breakaway insert type use indicator are illustrated in FIGS. 5 and 6. Referring to FIG. 5, a sleeve 28 fits over pull tab 10. Finger hole 30 in sleeve 28 is aligned with finger hole 20 in pull tab 10. Breakaway use indicator 24 is attached to a body portion 32 of sleeve 28. Use indicator 24 projects into and blocks a substantial portion of finger hole 30 in sleeve 28 and, correspondingly, finger hole 20 in pull tab 10. Use indicator 24 is attached to body 32 through a comparatively weak and easily broken bridge region 26. Sleeve 28 is sized and shaped to snap-fit over pull ring 21. Alternatively, sleeve 28 could be bonded to pull ring 21 with a suitable adhesive or solvent. Again, when the user inserts a finger into finger holes 30 and 20, use indicator 24 is broken out of sleeve 28.

Referring to FIG. 6, use indicator 24 is formed as part of a ring shaped insert 34. Insert 34 defines a finger hole 36 along its interior dimension. Insert 34 is sized and shaped to snap-fit into pull ring 21, similar to the pull ring inserts used in some conventional toner dam pull tabs. Use indicator 24 projects into and blocks a substantial portion of finger hole 36 in pull ring insert 34 and, correspondingly, finger hole 20 in pull tab 10. Use indicator 24 is attached to pull ring insert 34 through a comparatively weak and easily broken bridge region 26. When the user inserts a finger into finger holes 36 and 20, use indicator 24 is broken out of insert 34

In the embodiments of the invention illustrated in FIGS. 7, 8, 9 and 10, a disfiguring label is used to indicate a used cartridge. FIGS. 7, 8, 9 and 10 are representational end views of a print cartridge 14 such as might be used in a laser printer. The housing 12 of cartridge 14 is formed generally in two sections—a toner reservoir section 38 and print component section 40. Toner is stored in toner reservoir 38. The photoconductor 42 and the charging and toner delivery assemblies (not shown) are mounted in the print component section 40. Depending on the type of print cartridge, the two sections of housing 12 may be formed as an integral unit, or attached to one another as individual sections. In either case, toner dam 16 extends along the opening 44 between the toner reservoir 38 and the print component section 40 of housing 12.

Figure 9:
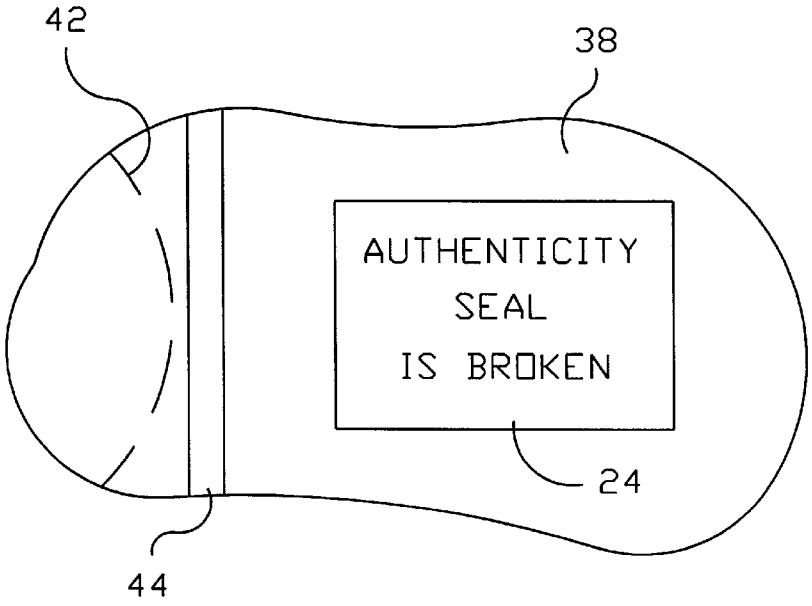
FIG. 9 is a partial detail view of the print cartridge of FIG. 7 or FIG. 8 after the identifying tape is removed.
Figure 7:
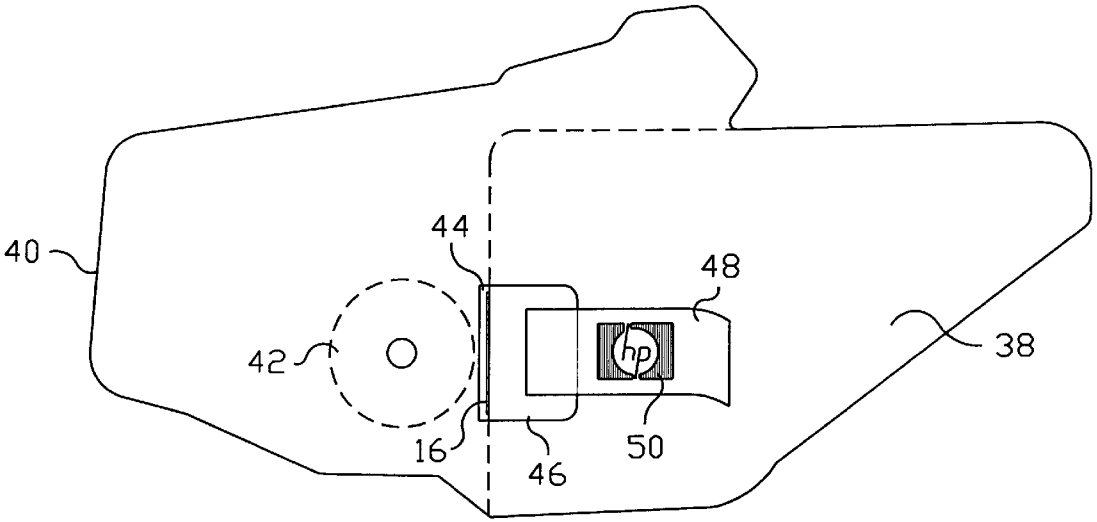
FIG. 7 is a representational end view of a print cartridge showing a toner dam pull tab secured to the housing of the print cartridge by an identifying tape that leaves a permanent use indicator imprint on the cartridge.
Figure 8:
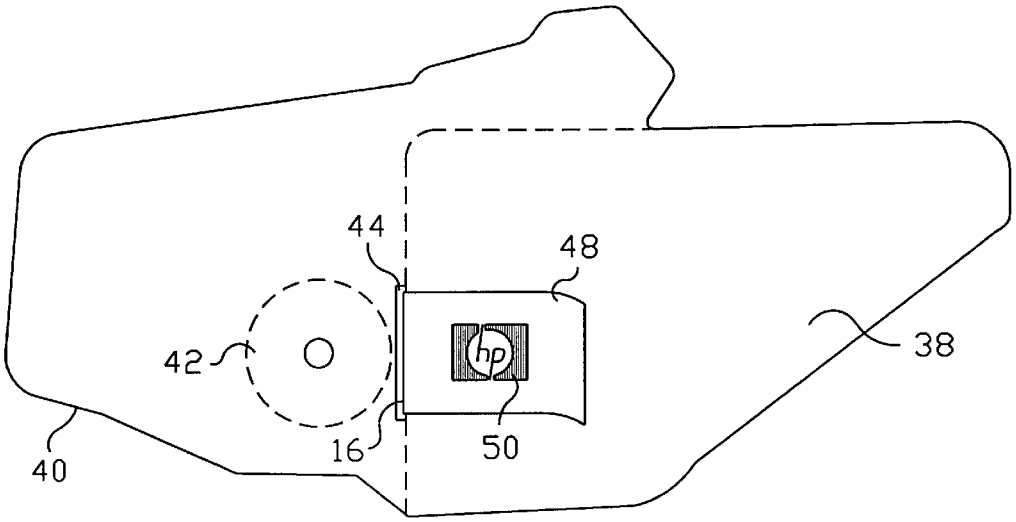
FIG. 8 is a representational end view of a print cartridge showing an identifying tape formed as part of the toner dam.

In FIG. 7, toner dam 16 is attached to a pull tab 46. Pull tab 46 is laid against the end of housing 12 and secured with an identifying tape 48. In FIG. 8, the pull tab is omitted and identifying tape 48 is formed as part of, or attached directly to, the end of toner dam 16. Identifying tape 48 is coated or imprinted on the front side with an identifying symbol 50, such as the Hewlett Packard Company logo. Identifying tape 48 is coated or imprinted on the back side with a use indicator 24 that will permanently adhere to the housing 12 when tape 48 is removed, as shown in FIG. 9. When identifying tape 48 is lifted to allow for the removal of toner dam 16, the use indicator 24 is left permanently on housing 12. Use indicator 24 tells the user that the authenticity seal is broken. Other messages, symbols or identifiers could be used to indicate to the user that the cartridge has been used, or at least that the protective barrier has been removed. Any suitable tape, label or foil that leaves behind a substantially permanent imprint may be used for identifying tape 48.

Figure 10:
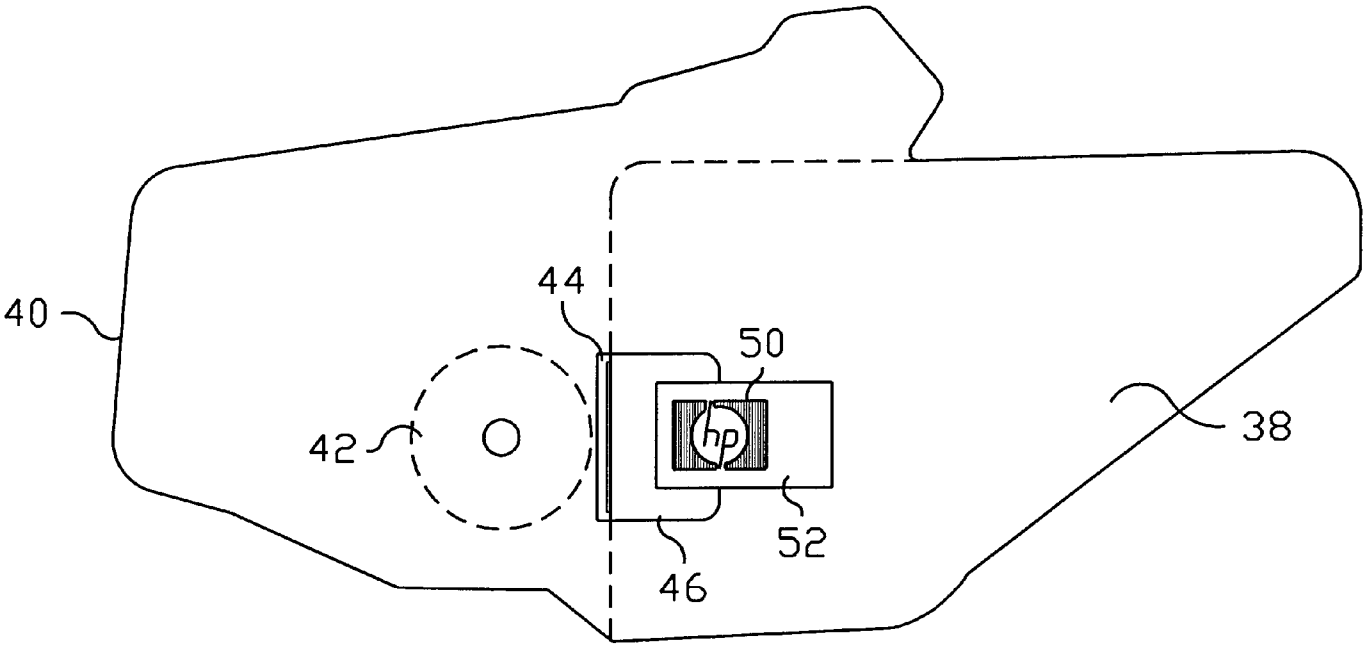
FIG. 10 is a representational end view of a print cartridge showing a toner dam pull tab secured to the housing of the print cartridge by a label that must be disfigured to grasp and pull the pull tab.

In one variation of this disfiguring label embodiment, illustrated in FIG. 10, a permanently adhering label 52 is used to secure pull tab 46 or toner dam 16 instead of the removable tape. Label 52, therefore, must be torn, cut or otherwise disfigured to allow for the removal of toner dam 16. Label 52 can be perforated, if desired, to make it easier to release the pull tab and toner dam. Also, label 52 may carry an identifying symbol, although the identifying symbol is not necessary because the remnants of the torn label on housing 12 indicate that the cartridge has been used.

Figure 11:
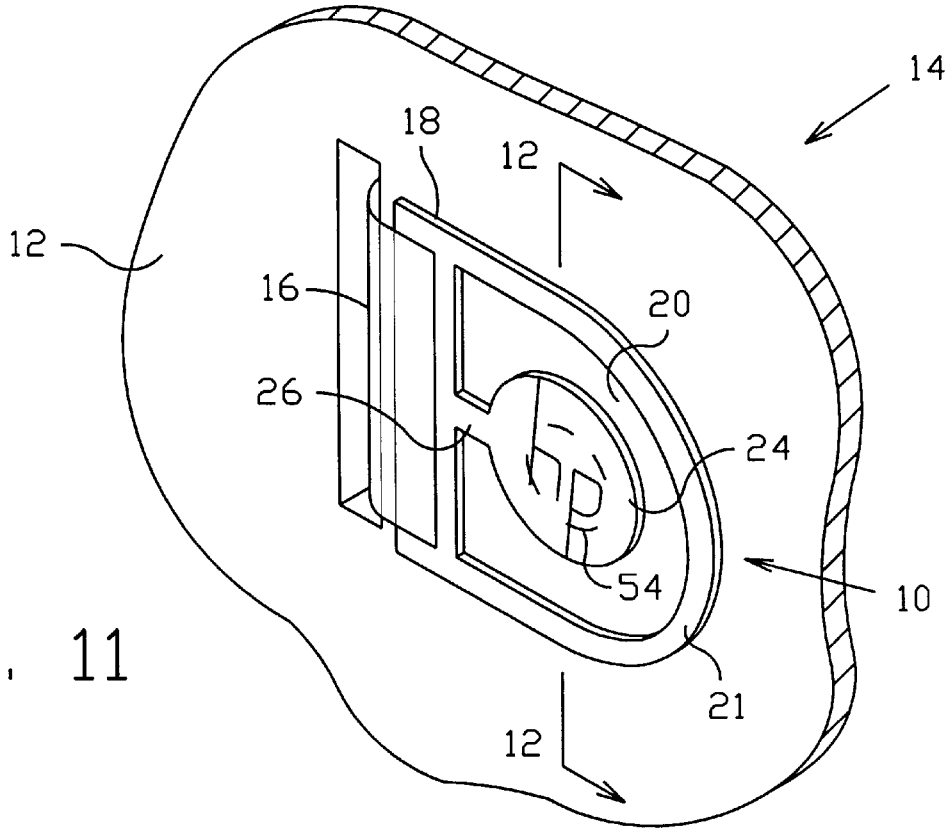
FIG. 11 is a perspective view of a portion of the end of a print cartridge showing an anti-fraud pull tab with a breakaway insert type use indicator anchored to the housing of the print cartridge.
Figure 12:
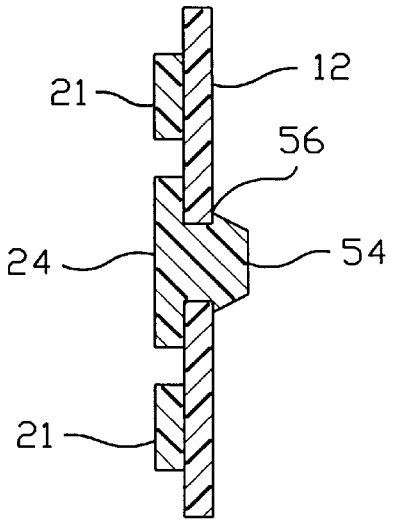
FIG. 12 is a section view taken along the line 12—12 in FIG. 11 showing the use indicator anchored to the print cartridge housing.

In another variation illustrated in FIGS. 11 and 12, use indicator 24 is a breakaway insert anchored to housing 12 of print cartridge 14. Before removal of the toner dam, pull tab 10 is secured generally flush with housing 12 by anchor 54 on use indicator 24. Anchor 54 is an arrow shaped projection that is pushed through opening 56 in housing 12. The lip on anchor 54 permanently secures use indicator 24 to housing 12 once anchor 54 is pushed through opening 54. When pull tab 10 is lifted away from housing 12 to remove toner dam 16, use indicator 24 breaks away from pull tab 10 and remains anchored to housing 12.

While the present invention has been shown and described with reference to the foregoing preferred embodiments, it will be apparent to one skilled in the art that other forms and details may be made thereto without departing from the spirit and scope of the invention as defined in the following claims.

What is claimed is:

1. A sleeve for use with a pull tab having a pull ring, the sleeve comprising:

a body sized and shaped to fit over the pull tab, the body having a hole therein aligned with the hole in the pull ring when the sleeve is installed on the pull tab; and a use indicator connected to the body of the sleeve, the use indicator blocking a substantial portion of the hole in the body of the sleeve.

2. A pull tab according to claim 1, wherein the use indicator comprises a piece of breakable material configured to prevent use of the pull tab without first breaking the material.

3. A sleeve according to claim 1, wherein the use indicator comprises a breakable membrane covering the hole in the body of the sleeve.

4. A sleeve according to claim 1, wherein the use indicator projects into the hole in the body of the sleeve, the use indicator attached to the body of the sleeve through a bridge region that is easily broken when a finger is inserted into the hole.

5. An anti-fraud pull tab assembly for printing products, comprising:

a pull tab having a pull ring, the pull ring defining a hole in the pull tab;

a sleeve sized and shaped to fit over the pull tab, the sleeve having a hole therein aligned with the hole in the pull ring when the sleeve is installed on the pull tab; and a use indicator on the sleeve blocking a substantial portion of the hole in the sleeve.

6. An insert for a pull tab having a pull ring, the insert comprising:

a body sized and shaped to fit into the pull ring, the body having a hole therein; and a use indicator connected to the body of the insert, the use indicator blocking a substantial portion of the hole in the body of the insert.

7. A pull tab according to claim 6, wherein the use indicator comprises a piece of breakable material configured to prevent use of the pull tab without first breaking the material.

8. An insert according to claim 6, wherein the use indicator projects into the hole from the body of the insert, the use indicator attached to the body of the insert through a bridge region that is easily broken when a finger is inserted into the hole.

9. An anti-fraud pull tab assembly for printing products, comprising:

a pull tab having a pull ring, the pull ring defining a hole in the pull tab;

an insert sized and shaped to fit into the pull ring, the insert having a hole therein; and a use indicator on the insert blocking a substantial portion of the hole in the insert.

10. A print cartridge, comprising:

a housing having a toner reservoir section and a print component section;

a removable protective barrier covering an opening between the toner reservoir section and the print component section;

a pull tab attached to the protective barrier, the pull tab having a pull ring defining a hole; and a use indicator blocking a substantial portion of the hole.

11. A print cartridge according to claim 10, wherein the use indicator comprises a piece of breakable material configured to prevent use of the pull tab without first breaking the material.

12. A print cartridge according to claim 10, further comprising an identifying symbol on the use indicator.

* * * * *